US006866014B2

(12) United States Patent
Spath

(10) Patent No.: US 6,866,014 B2
(45) Date of Patent: Mar. 15, 2005

(54) ANTI-ROTATION GUIDE FOR A DEACTIVATION HYDRAULIC VALVE LIFTER

(75) Inventor: Mark J. Spath, Spencerport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/422,308

(22) Filed: Apr. 24, 2003

(65) Prior Publication Data

US 2004/0211375 A1 Oct. 28, 2004

(51) Int. Cl.[7] ..... F01L 1/46
(52) U.S. Cl. ..... 123/90.5; 123/90.16; 74/569
(58) Field of Search ..... 123/90.16, 90.5, 123/90.15, 90.27, 90.31, 90.48, 90.42, 90.44; 74/569, 567

(56) References Cited

U.S. PATENT DOCUMENTS 3,108,580 A * 10/1963 Crane ..... 123/90.5
4,089,234 A * 5/1978 Henson et al. ..... 74/569
4,207,775 A * 6/1980 Lintott ..... 74/55
5,088,455 A 2/1992 Moretz
5,307,769 A * 5/1994 Meagher et al. ..... 123/90.5
5,546,899 A * 8/1996 Sperling et al. ..... 123/90.5
5,934,232 A * 8/1999 Greene et al. ..... 123/90.16
6,405,699 B1 * 6/2002 Church ..... 123/90.5
6,439,176 B1 8/2002 Payne et al.
6,497,207 B2 12/2002 Spath et al.
6,513,470 B1 2/2003 Hendriksma et al.
6,578,535 B2 6/2003 Spath et al.
6,591,796 B1 7/2003 Scott
6,615,783 B2 * 9/2003 Haas et al. ..... 123/90.48
2003/0070636 A1 * 4/2003 Evans et al.

* cited by examiner

*Primary Examiner*—Thomas Denion
*Assistant Examiner*—Ching Chang
(74) *Attorney, Agent, or Firm*—Patrick M. Griffin

(57) ABSTRACT

An anti-rotation guide for a deactivation hydraulic valve lifter for an internal combustion engine. The guide includes a through bore accommodating of a hydraulic valve lifter and is sized such that the outer end of the lifter may be inserted into the through bore of the guide. The guide is securable to the engine such that the lifter is reciprocable within the guide. The guide is provided with two opposing keepers for mating with corresponding flats on the lifter to prevent rotation of the lifter. Further, a keyway means is provided in the guide and lifter to prevent the lifter being inserted into the guide 180° from the correct orientation.

5 Claims, 9 Drawing Sheets

ANTI-ROTATION GUIDE FOR A DEACTIVATION HYDRAULIC VALVE LIFTER

TECHNICAL FIELD

The present invention relates to hydraulic valve lifters for use with internal combustion engines, more particularly, to an anti-rotation guide which prevents rotation of a deactivation hydraulic valve lifter in a push-rod internal combustion engine, and even more particularly, to an anti rotation guide that minimizes frictional loss between the guide and the lifter body of a deactivation hydraulic valve lifter.

BACKGROUND OF THE INVENTION

Cylinder deactivation during at least a portion of the combustion process is a proven method by which fuel economy can be improved. With fewer cylinders performing combustion, fuel efficiency is increased and the amount of pollutants emitted from the engine is reduced. A known method of providing cylinder deactivation in a push rod engine is by using a deactivation mechanism in the hydraulic valve lifter.

A hydraulic valve lifter, whether of the deactivating or non-deactivating type, slides reciprocally in an engine bore. The lifter engages a camshaft lobe via a camshaft follower which typically is a roller follower. Unless suitably guided by an anti-rotation mechanism, the lifter may rotate in its bore during reciprocation, thereby undesirably misaligning its follower from the associated cam lobe.

One version of a prior art anti-rotation guide that prevents rotation of a standard (non-deactivation) hydraulic roller lifter is in the form of a flat plate having apertures for receiving the lifter bodies. The apertures are sized to freely permit reciprocation of the lifter in the guide plate and include a flatted portion along each aperture periphery to matingly engage a flatted portion on each lifter body to prevent the lifter from rotating during reciprocation. In the flat plate version, each lifter must first be individually inserted into its respective engine bore. Then, the plate is positioned on the engine, each guide plate aperture receiving a lifter in its proper rotational orientation. Lastly, the plate is rigidly secured to the engine thereby preventing the lifters from rotating during engine operation.

Another version of a prior art anti-rotation guide used to keep the follower of a standard hydraulic lifter in alignment with the cam lobe is disclosed in U.S. Pat. No. 5,088,455. In that version, the guide is used to also "kit" a bank of lifters prior to engine assembly by snuggly gripping a portion of the lifter body via a substantial interference fit across flatted segments of the lifter body. Because the guide snuggly grips each lifter, a significant frictional drag is created between the lifter and guide which can impede hydraulic recovery of the lifter's hydraulic plunger assembly after being drained of oil during shutdown. In some non-deactivation lifters, frictional drag from the interference fit of a gripping guide can be readily compensated for by increasing the size and internal spring force of the hydraulic plunger assembly. However, because of size constraints placed on the deactivation lifter design, this remedy cannot be readily applied to a deactivation lifter assembly.

In addition, deactivation lifters, as known in the prior art, require a specific rotational orientation to mate with a deactivation oil passage in the engine. A single flat on the lifter body for mating with a corresponding flat on the guide would assure proper alignment with the engine oil passage.

However, with only a single flat, some amount of anti-rotation protection is lost. Greater anti-rotation protection could be provided via two opposing flats, but this would defeat the orientation preference needed by deactivation lifters as conferred by a single flat.

Finally, anti-rotation guides known in the art, and used with standard hydraulic lifters, are closed-ended, providing only a clearance orifice for the associated push rod to reciprocate through the guide. Such a guide cannot accommodate a deactivation hydraulic lifter having an external spring tower which is substantially greater in diameter than the push rod.

Therefore, what is needed in the art is an anti-rotation guide which accommodates a deactivation lifter and prevents the hydraulic lifter from rotating in its bore during reciprocation.

What is further needed in the art is an anti-rotation guide which minimizes friction and binding between the guide and the deactivation lifter while also retaining the lifter for kitting purposes.

SUMMARY OF THE INVENTION

The present invention provides an anti-rotation guide for a deactivation hydraulic valve lifter.

A guide in accordance with the invention is a funnel-shaped element having walls tapering from a larger opening to a smaller opening accommodating of a deactivation hydraulic valve lifter. The smaller opening is sized such that an end of the lifter, which on a deactivation lifter includes the spring tower, may be inserted through the opening and into the guide. The shape of the element permits articulation of a pushrod engaged with the lifter. The guide is fixedly securable to the engine such that the lifter is reciprocable within the guide.

The smaller opening of the guide is provided with guide keepers having two flats for mating with corresponding flats on the lifter to prevent rotation of the lifter. In the present invention, the keepers serve to engage an outer ridge portion on the lifter and thereby loosely hold the lifters in place in the guide ("kitting") during engine assembly. The guide flats are preferably formed in an hourglass shape to permit a degree of angular movement of the lifter relative to the guide to prevent binding during reciprocation. Further, a groove is provided in the guide opening or lifter for receiving a longitudinal rib on the mating part to prevent the lifter from being inserted into the guide 180° from the correct orientation. Preferably, the mating walls of the groove and rib of the present invention are formed perpendicular to the flats on the lifter to provide greater resistance to lifter rotation during engine operation.

Further, ramped flutes disposed longitudinally along the inner walls of the guide opening are provided to center the pushrod into the lifter during assembly. The inside diameter of the lost motion spring tower is stepped as well to aid in centering of the pushrod and to provide operational clearance to the pushrod.

In a currently-preferred embodiment, anti-rotation guides are provided in guide elements comprising four guides for four valves, two intake and two exhaust, for economy of manufacture and installation. Each of the guides are preferably equipped with a lifter in a pre-assembled kit which then is inserted directly into the engine during assembly thereof, the correct rotational orientation of the lifters and lifter position relative to respective cylinders thus being assured.

An advantage of the present invention is that the anti-rotation retains the lifter prior to engine installation.

A further advantage of the present invention is that, once installed, the anti-rotation guide tightly constrains the deactivation lifter rotationally but loosely constrains the lifter axially such that minimal frictional resistance is encountered during axial actuation of the lifter.

Yet another advantage of the present invention is that a means is provided in the anti-rotation guide to permit a degree of angular movement of the lifter relative to the guide.

BRIEF DESCRIPTION OF THE DRAWINGS

These and other features and advantages of the invention will be more fully understood and appreciated from the following description of certain exemplary embodiments of the invention taken together with the accompanying drawings, in which.

Corresponding reference characters indicate corresponding parts throughout the several views. The exemplifications set out herein illustrate one preferred embodiment of the invention, in one form, and such exemplifications are not to be construed as limiting the scope of the invention in any manner.

DESCRIPTION OF THE PREFERRED EMBODIMENT

Figure 1:
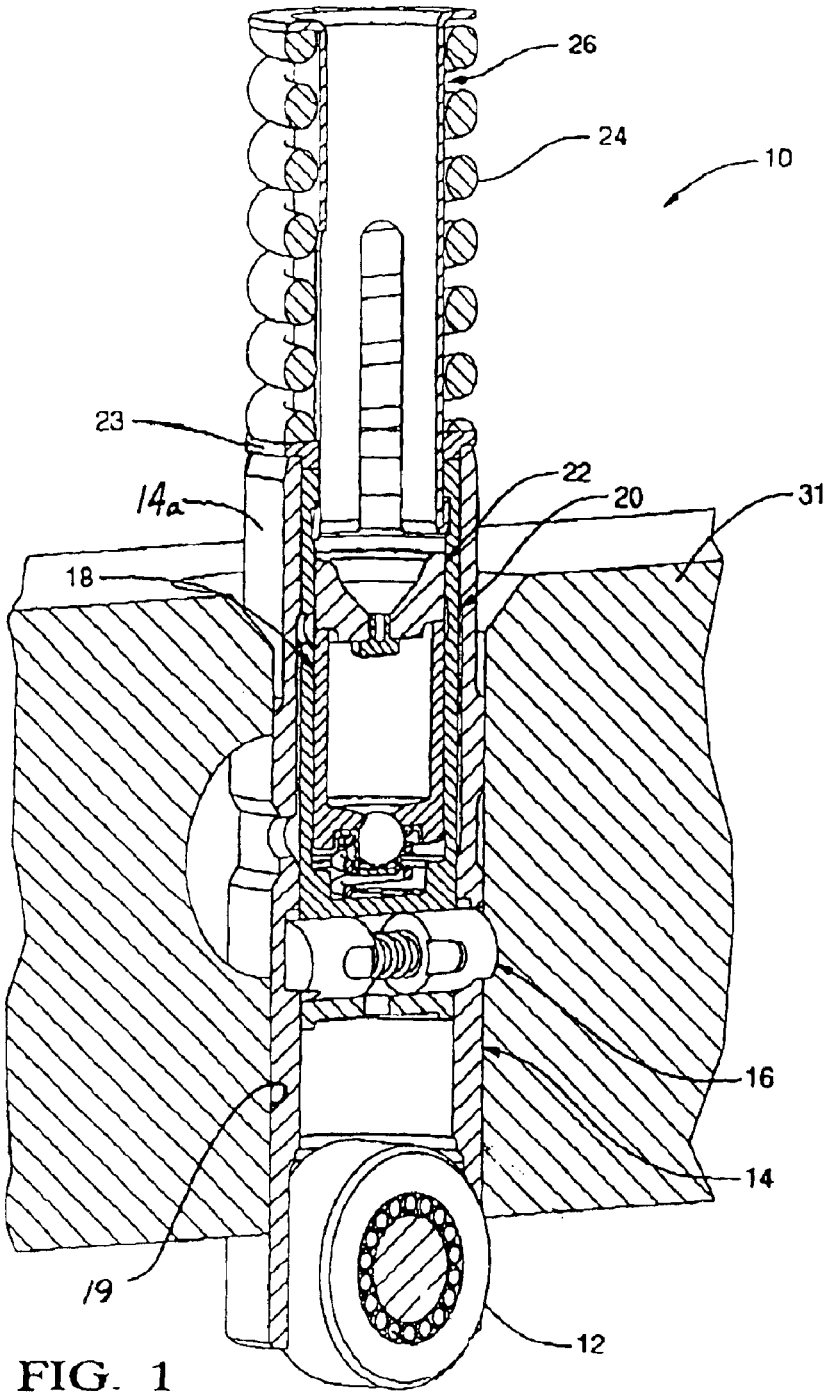
FIG. 1 is a partially sectioned, perspective view of a deactivation roller hydraulic valve lifter used in conjunction with an anti-rotation guide in accordance with the present invention.

Referring to the drawings and particularly to FIG. 1 herein, a deactivation roller hydraulic valve lifter (DRHVL) 10, as disclosed in U.S. Pat. No. 6,513,470, includes roller 12, lifter body 14, deactivation pin assembly 16, plunger assembly 18, pin housing 20, pushrod seat assembly 22, spring seat 23, lost motion spring 24, and spring tower 26. As shown, DRHVL 10 is inserted into its respective bore 19 of engine 31 for engagement with the engine camshaft (not shown).

Roller 12, associated with body 14 of DRHVL 10, rides on a lobe of the camshaft and translates the rotary motion of the camshaft to vertical motion of lifter body 14. An anti-rotation guide (not shown in FIG. 1) secured to the engine fits around the lifter body to prevent the lifter from rotating during reciprocation. Deactivation pin assembly 16 normally engages lifter body 14 and transfers the vertical reciprocation of lifter body 14 to pin housing 20. Vertical reciprocation is, in turn, transferred to plunger assembly 18 and pushrod seat assembly 22. Deactivation pin assembly 16 can be selectively disengaged to decouple lifter body 14 from pin housing 20 and to decouple plunger assembly 18 and pin housing 20 from the vertical reciprocation of lifter body 14.

Lifter body 14 includes on its outside surface at least one anti-rotation flat 14*a* which is aligned with a similar anti-rotation flat on the interior surface of the anti-rotation guide. Alignment of these flats prevent the lifter from rotating within the guide during reciprocation of the lifter.

In the anti-rotation guide disclosed in U.S. Pat. No. 5,088,455, the flats on the outside surface of the lifter body are tight fitting to similar flats on the inside surface of the anti-rotation guide so that the guide can snuggly grip the lifter body as a kitted lifter/guide assembly. The assembly relies on the snug grip to keep the lifter in place and in its proper orientation with the cam lobe during engine assembly. With the anti-rotation guides properly positioning and aligning each lifter as a kit, each lifter can be readily inserted into its respective bore 19.

Figure 2A:
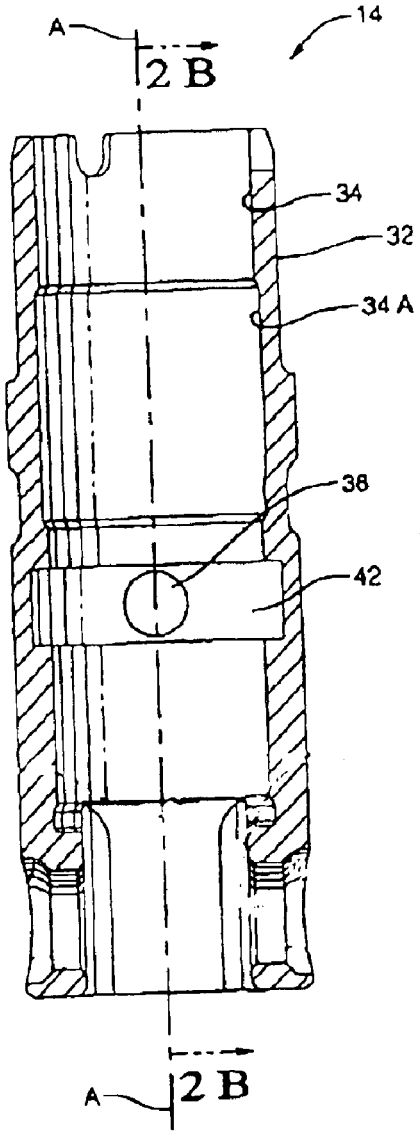
FIG. 2A is an axially-sectioned view of the lifter body of FIG. 1.
Figure 2B:
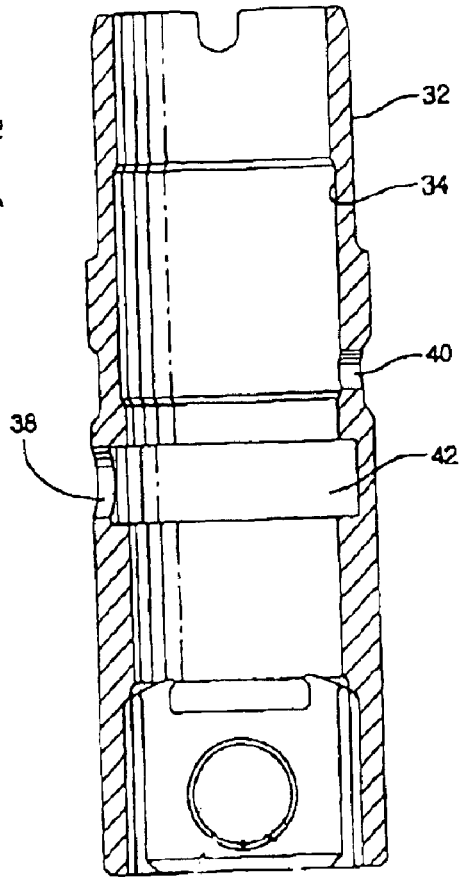
FIG. 2B is an axially-sectioned view of the lifter body of FIG. 1 rotated by 90 degrees.

Referring now to FIGS. 2*a* and 2*b*, lifter body 14 is an elongate cylindrical member dimensioned to be received within the space occupied by a standard roller hydraulic valve lifter. Lifter body 14 has central axis A and includes cylindrical wall 32 having an inner surface 34. Inner surface 34 includes circumferential oil supply recess 34*a*. Inner surface 34 of cylindrical wall 32 defines annular pin chamber 42. Pin chamber 42 is a contiguous chamber of a predetermined axial height which extends around the entire circumference of inner surface 34 of cylindrical wall 32. Control port 38 is defined by an opening that extends through cylindrical wall 32, terminating at and opening into annular pin chamber 42. Pressurized oil is injected through control port 38 into annular pin chamber 42 in order to retract deactivation pin assembly 16 from within annular pin chamber 42. Oil port 40 passes through cylindrical wall 32 and into oil supply recess 34*a*, thereby providing a passageway for supplying the hydraulic lash mechanism with oil, as known in the art.

As best shown in FIG. 1, deactivation pin assembly 16 includes preferably two pin members 46, 48 interconnected by and biased radially outward relative to lifter body 14 by pin spring 50. Each of pin members 46, 48 are dimensioned to be received within annular pin chamber 42. A small gap G is provided between stepped flats 46*a*, 48*a* and the lower edge of annular pin chamber 42. Gap G provides for clearance between flats 46*a* and 48*a* and the lower edge of annular pin chamber 42, thereby allowing for free movement of pin members 46 and 48 into pin chamber 42. Each of pin members 46 and 48 define pin bores 52 and 54, respectively. Each of pin bores 52 and 54 receive a corresponding end of pin spring 50. In its normal or default position, pin members 46 and 48 of deactivation pin assembly 16 are biased radially outward by pin spring 50 such that at least a portion of each pin member 46 and 48 is disposed within annular pin chamber 42 of lifter body 14.

Figure 4:
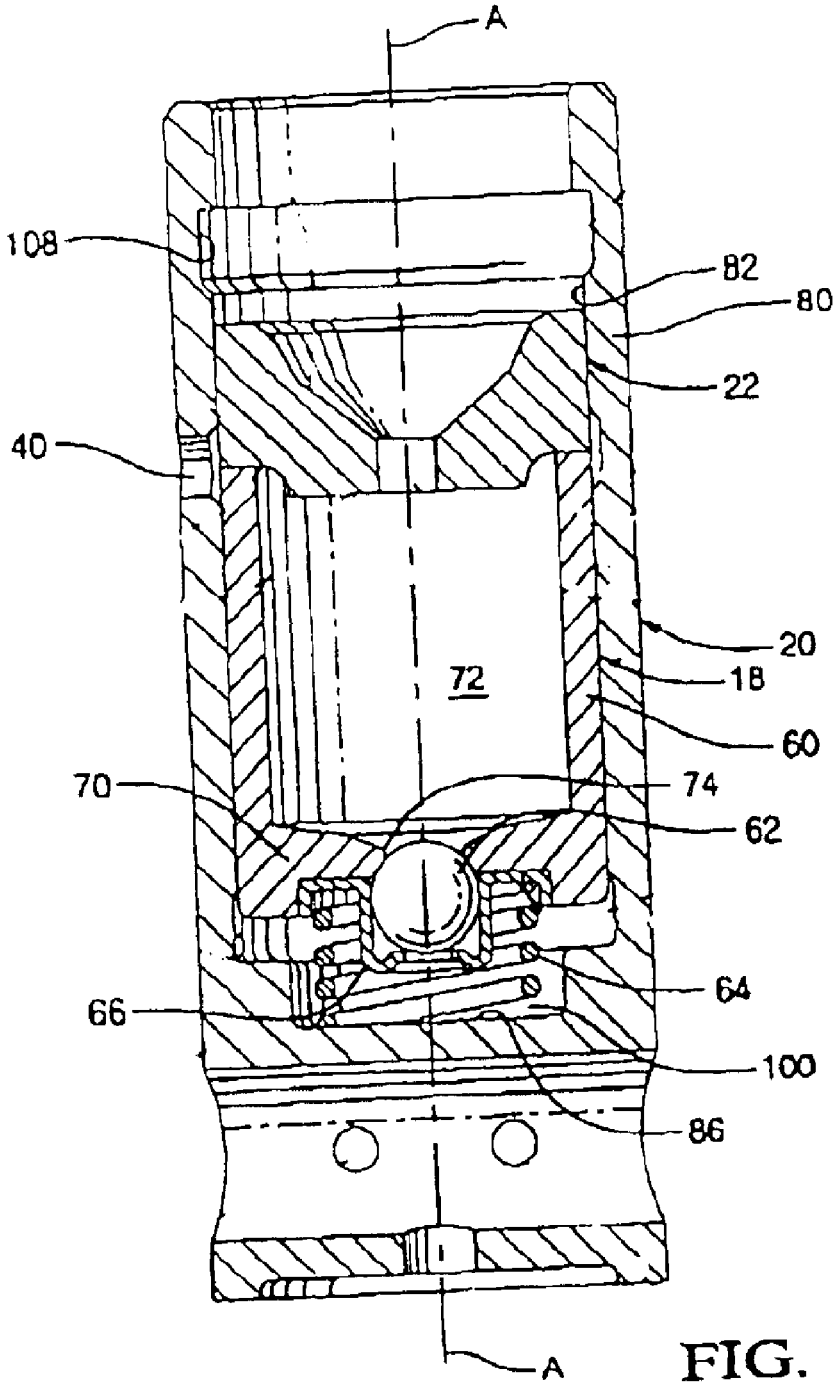
FIG. 4 is an axially-sectioned view of the pin housing, plunger assembly, and push rod seat of FIG. 1.

Referring to pin housing 20 and plunger assembly 18 as shown in FIG. 4, high pressure chamber 100 is conjunctively defined by bottom inner surface 86 of pin housing 20, plunger bottom 70 of plunger assembly 18, and the portion of inner surface 82 of cylindrical side wall 80 of pin housing 20 disposed therebetween. Plunger orifice 74 provides a passageway for the flow of fluid, such as, for example, oil, between high pressure chamber 100 and low pressure chamber 72. The ball-type check valve formed by plunger ball 62, plunger spring 64, and ball retainer 66 selectively controls the ability of the fluid to flow through plunger orifice 74.

Figure 3:
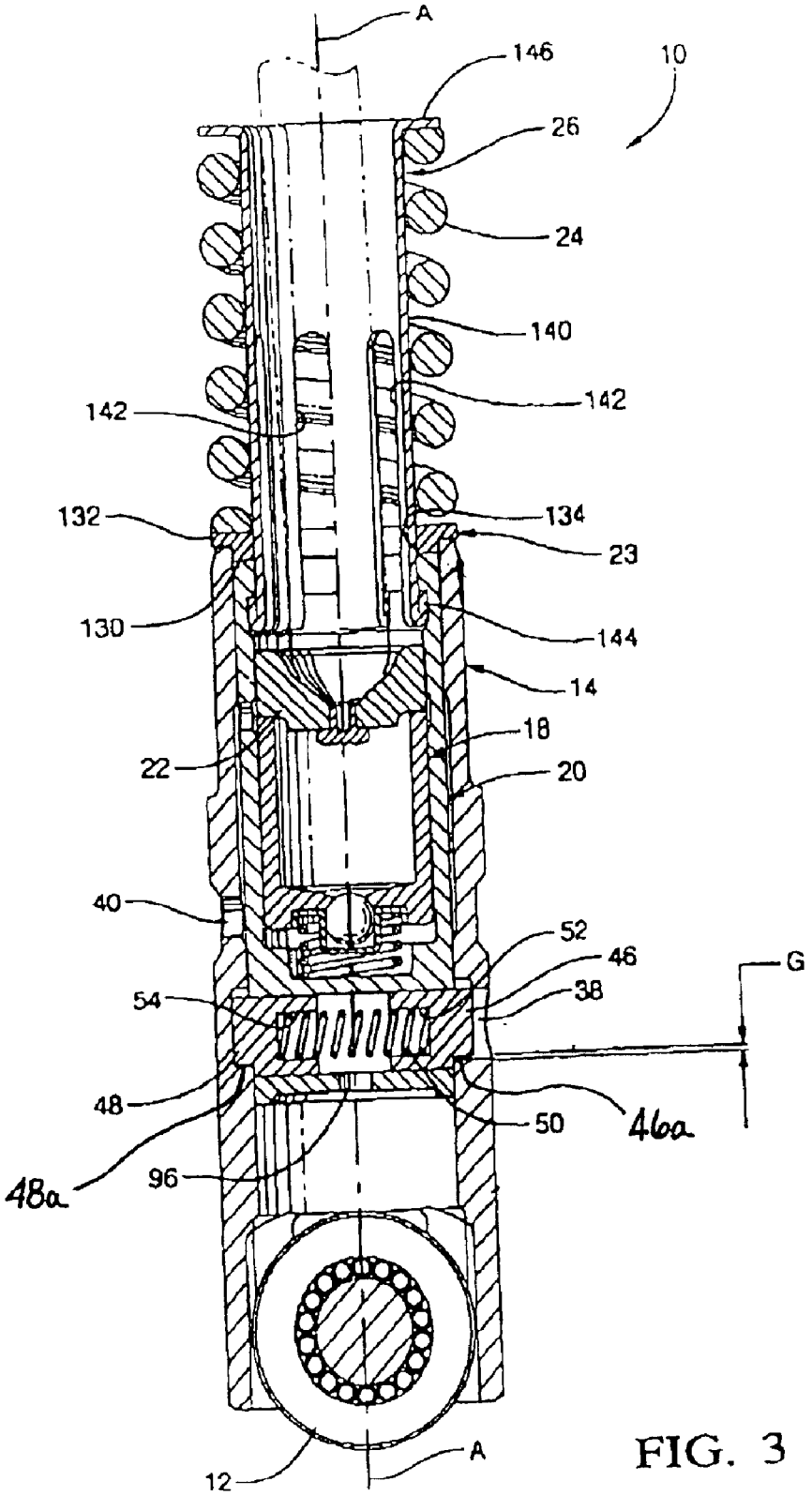
FIG. 3 is an axially-sectioned view of FIG. 1.

Spring seat 23, as best shown in FIG. 3, is a ring-shaped member, having collar 130, flange 132, and orifice 134. Collar 130 is disposed concentrically within lifter body 14 and adjacent to the top edge of side wall 80 (FIG. 4) of pin housing 20. Flange 132 extends radially from collar 130 such that flange 132 overlaps onto the top edge of cylindrical wall 32 of lifter body 14. The height of gap G is determined by the dimensions of spring seat 23. More particularly, the length of the axial extension of collar 130 into lifter body 14 determines the axial position of pin housing 20 relative to lifter body 14, thereby determining the height of gap G.

Lost motion spring 24 is a coil spring having one end associated with spring seat 23 and the other end associated with spring tower 26. Lost motion spring 24 has a predetermined installed load which is selected to prevent hydraulic element pump up due to oil pressure in high pressure chamber 100 and due to the force exerted by plunger spring 64.

Spring tower 26, as best shown in FIG. 3, is an elongate cylindrical member having an outer wall 140. A plurality of slots 142 are defined in outer wall 140. Tabs 144 are formed along the bottom end of outer wall 140. A portion of outer wall 140 is concentrically disposed within pin housing 20, adjacent to inner surface 82 of side wall 80. Slots 142 enable spring tower 26 to be flexible enough to be pushed downward into pin housing 20 until each of tabs 144 are received within and snap into or engage upper annular groove 108 (FIG. 4) formed in side wall 80 of pin housing 20. Spring tower 26 defines at its top end tower collar 146, which is associated with the top end of lost motion spring 24. The lower end of spring tower 26, disposed within pin housing 20, acts to limit the extended height of pushrod seat assembly 22.

In the deactivated state of DRHVL 10, as lifter body 14 is vertically displaced by the engine cam lobe, lost motion spring 24 is compressed. As the cam lobe returns to its lowest lift profile, lost motion spring 24 expands and exerts, through spring seat 23, a downward force on lifter body 14. Any lift loss that occurs due to leakdown is recovered through the expanding action of plunger spring 64. Thus, the lash remaining in DRHVL 10 is limited to the gap G which is precisely set through the dimensions of spring seat 23. Lengthening collar 130 places pin housing 20 axially lower relative to lifter body 14 thereby decreasing the height of gap G. By adjusting the axial dimension of collar 130, variations in manufacturing tolerances and variations in the dimensions of the component parts of DRHVL 10 can be accurately compensated for while a tight tolerance on gap G is accurately maintained.

Lost motion spring 24 prevents separation between DRHVL 10 and the engine cam lobe in the deactivated or disengaged state. Further, lost motion spring 24 resists the expansion of DRHVL 10 when the cam is at its lowest lift profile position. The tendency of DRHVL 10 to expand is due to the force exerted by plunger spring 64 and oil pressure within high pressure chamber 100 acting upon plunger 60 of assembly 18. These forces tend to displace pin housing 20 downward toward roller 12, thereby reducing gap G. Thus, the oil pressure within high pressure chamber 100 and the force exerted by plunger spring 64 will expand, or pump-up, DRHVL 10 by displacing pin housing 20 downward toward roller 12. Spring tower 26 is firmly engaged with pin housing 20. Therefore, any downward movement of or force upon pin housing 20 will be transferred to spring tower 26. Thus, a compressive force, or a force in a direction toward roller 12, is exerted upon lost motion spring 24 via the downward force or movement of pin housing 20. The pre-load or installed load of lost motion spring 24 is selected to resist the tendency of DRHVL 10 to pump-up or expand. If expansion is not resisted or limited by the installed load of lost motion spring 24, gap G will be reduced as pin housing 20 is displaced downward relative to pin chamber 42, and may adversely affect the ability of locking pin members 46, 48 to engage within pin chamber 42.

Figure 5:
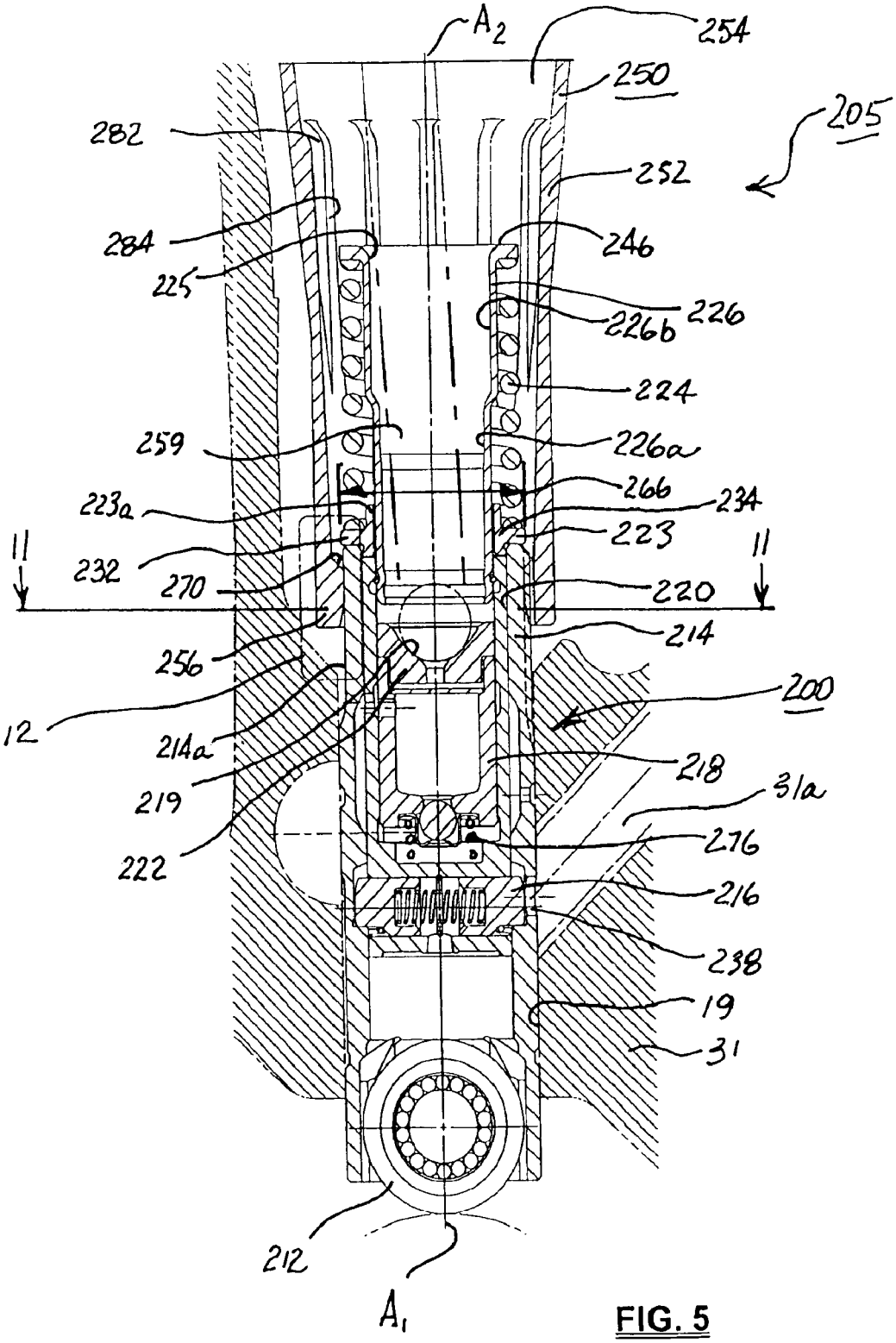
FIG. 5 is an axially-sectioned view of an anti-rotation guide and deactivation roller hydraulic valve lifter in accordance with the present invention.

Referring now to FIG. 5, a deactivation roller hydraulic valve lifter and anti-rotation guide assembly 205, including DRHVL 200 and anti-rotation guide 250 of the present invention, is shown. DRHVL 200 has central axis A1, and includes roller 212, lifter body 214, deactivation pin assembly 216, plunger assembly 218, pin housing 220, pushrod seat assembly 222, spring seat 223, lost motion spring 224, and spring tower 226.

Anti-rotation guide 250 of the present invention has central axis A2, and includes generally cylindrical wall 252 surrounding bore 254, and keepers 256. Bore 254 defines a first diameter 258 (FIG. 11) as taken at a diameter orientation non-inclusive of keepers 256. DRHVL 200 is disposed in bore 254 of anti-rotation guide 250. Spring seat 223, in accordance with the invention, includes outer ridge portion 232 and inner ring portion 234. Inner ring portion 234 is associated with an edge surface of lifter body 214 and pin housing 220, as shown in FIG. 5. Spring seat 223 serves both to set gap G as described above, and, via outer ridge portion 232, to loosely retain DRHVL 200 in guide 250, as will be described below.

Figure 11:
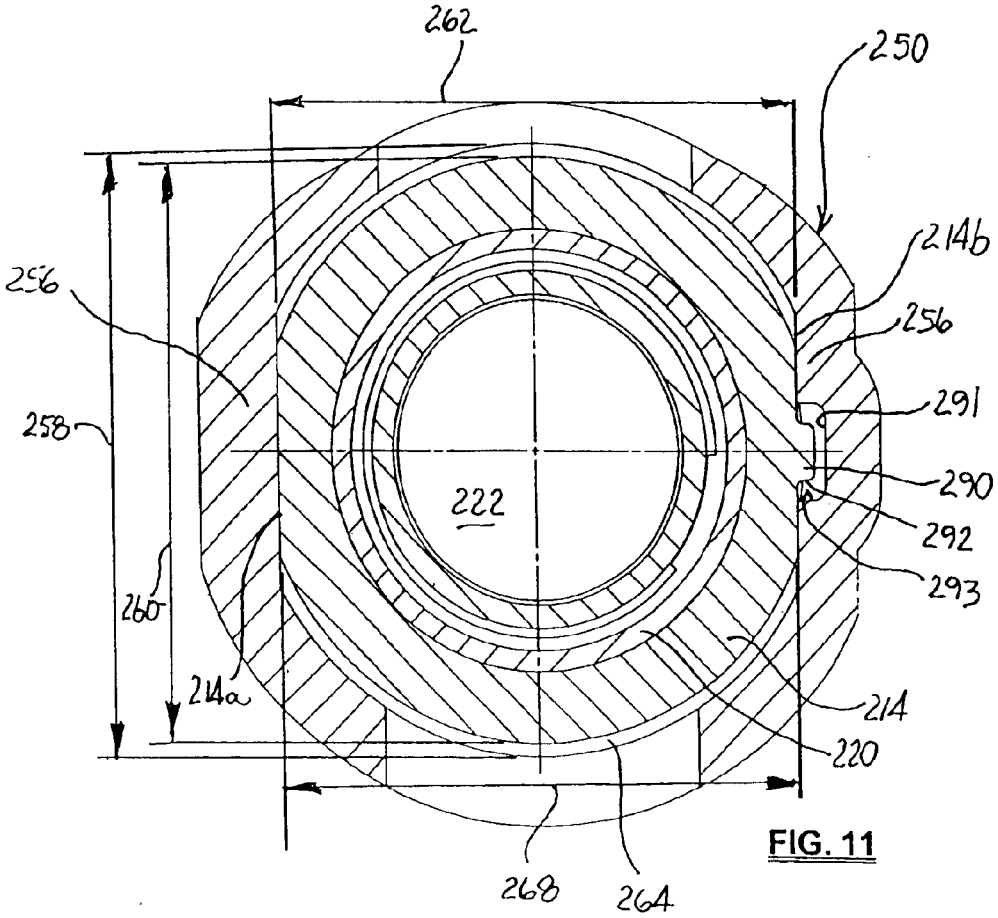
FIG. 11 is a cross-sectional view taken along line 11—11 in FIG. 5.

The generally cylindrical outer surface of lifter body 214 defines a second diameter 260 and includes recessed areas or flats 214*a*, 214*b*, disposed on the end of lifter body 214 opposite roller 212. First width 262, measured across keepers 256 engage corresponding flats 214*a*,214*b* in lifter body 214. Second diameter 260 of lifter body 214 is smaller than first diameter 258 of guide 250. That is, as shown in FIG. 11, after lifter body 214 is inserted into guide 250, an annular clearance 264 is formed between second diameter 260 and first diameter 258.

Second width 266 measured across outer ridge portion 232 of spring seat 223 (FIG. 5) extends slightly beyond a third width 268 of body 214 taken across flats 214*a* and 214*b*, such as, for example, by approximately 0.25 mm to approximately 0.75 mm.

When assembled as shown in FIG. 5, DRHVL 200 is inserted from the keeper end of anti-rotation guide 250 and pushed firmly into bore 254 of anti-rotation guide 250. Since second width 266 measured across outer ridge portion 232 is slightly greater than first width 262 measured across guide keepers 256, ridge portion 232 deflects keepers 256 until ridge portion 232 is disposed above ledge 270 (FIG. 12) of anti-rotation guide 250 and DRHVL 200 is retained within anti-rotation guide 250. Thus disposed, the portions of outer ridge portion 232 proximate flats 214*a*, 214*b* extend beyond the outer surface of lifter body 214 and engages or seats upon ledge 270, thereby retaining DRHVL 200 within anti-rotation guide 250 as a subassembly, (i.e., kitted), for easy installation within engine 31. Preferably, leading edge 272 and trailing edge 274 of outer ridge portion 232 are radiused to keep ridge portion 232 from biting into keepers 256 when the lifter is inserted into through bore 254. Spring seat 223 of DRHVL 200 optionally may include upper lip 223*a* around which a first end of lost motion spring 224 is disposed. Upper lip 223*a* prevents excessive radial movement of lost motion spring 224 relative to central axis A1 during operation of DRHVL 200.

While the present invention in FIG. 5 shows spring seat 223 having a collar portion extending downward toward pin housing 220, it is understood that seat 223, does not have to include a collar portion but may be a washer-like, flat member. Moreover, while outer ridge portion 232 is shown as being circular in shape and positioned generally concentric with the lifter body axis, it is understood that ridge portion 232 can be eccentric with the lifter body axis or, rather than being circular in shape, can take the shape of one or more tabs proximate flats 214*a*, 214*b*, extending beyond lifter body 214. Finally, while the present invention is shown as part of a deactivation lifter assembly having a spring tower and an external lost motion spring, it is contemplated that ridge portion 232 could be used in conjunction with a deactivation lifter having an internal lost motion spring or in conjunction with a standard (non-deactivation) lifter.

It should be particularly noted that using outer ridge portion 232 to retain DRHVL 200 within anti-rotation guide 250 substantially reduces friction between lifter body 214 and anti-rotation guide 250 relative to conventional methods of retaining lifters within anti-rotation guides. Prior art lifters are retained within anti-rotation guides by a substantial interference or frictional fit between the lifter body and the anti-rotation guide. In contrast, in the present invention DRHVL 200 is inserted into anti-rotation guide 250 until outer ridge portion 232 passes keeper portion 256 and seats on ledge 270 of anti-rotation guide 250. Minimum clearance 264 (or only a slight interference) between the guide and the lifter body permits free reciprocation of the lifter in the guide during engine operation. Thus, the engagement of ledge 270 by outer ridge portion 232 and not an interfering fit between the lifter body and guide retains DRHVL 200 within anti-rotation guide 250.

Figure 9A:
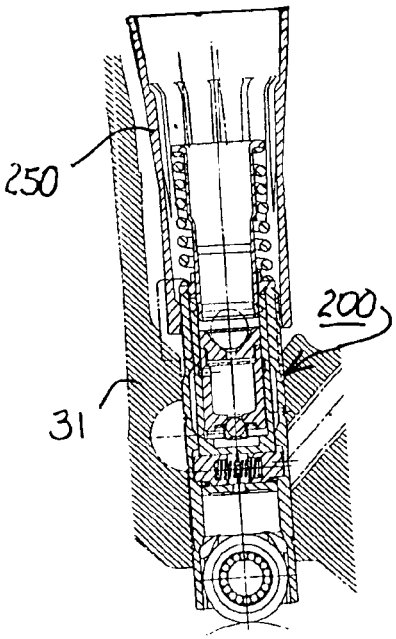
FIG. 9*a* is a vertical cross-sectional view taken along line 9—9 in FIG. 10, substantially equivalent to FIG. 5 showing the lifter on base circle.
Figure 9B:
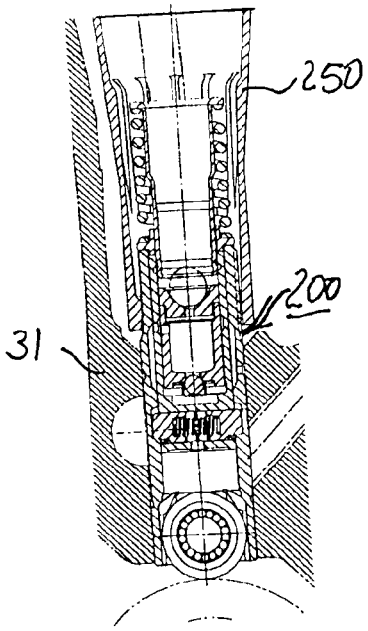
FIG. 9*b* is a vertical cross-sectional view taken along line 9—9 in FIG. 10 showing the lifter at maximum cam lift.
Figure 10:
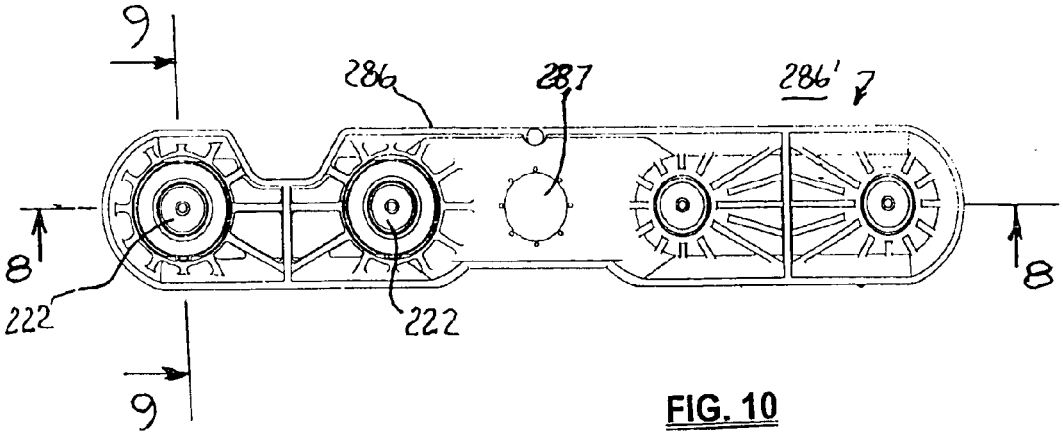
FIG. 10 is a plan view of the guide element assembly shown in FIGS. 6 and 7.

The interface between anti-rotation guide 250 and lifter body 214 imposes substantially no frictional force that counteracts the operation of DRHVL 200 in reciprocating between the valve-closed position (FIG. 9*a*) and the valve-open position (FIG. 9*b*), and thus has distinct advantages over the conventional methods of retaining a lifter within an anti-rotation guide as described above. Since the size of the plunger springs used in DRHVLs are limited due to the reduced size of the hydraulic element in such lifters as compared to the size of the hydraulic element in a standard non-deactivation lifter, reducing friction between lifter body 214 and anti-rotation guide 250 enables plunger spring 276 (FIG. 5) to be of a smaller size and of a smaller spring force, while still being of sufficient size/force to provide hydraulic recovery within DRHVL 200.

Generally, substantial or complete lifter collapse occurs when engine 31 is not operating, and in lifters that are engaged with or stopped upon a lifting portion of the profile of an associated cam lobe. The valve spring (not shown) of engine 31 pushes through pushrod 259 (shown in phantom in FIG. 5) and displaces plunger assembly 218 axially downward, i.e., in the direction of roller 212, within and relative to pin housing 220 which, in turn, compresses plunger spring 276 and causes the high pressure chamber to leak down. When engine 31 is first started, and engine oil pressure is relatively low, the only force available to recover leak down and reestablish engagement of pin housing 220, lifter body 214 and roller 212 with the cam lobe is the force exerted by plunger spring 276. Any friction between lifter body 214 and anti-rotation guide 250 may be sufficient to counteract the expansion force exerted by plunger spring 276, and can result in undesirable lifter noise or clatter, especially when the frictional force approaches the force of plunger spring 276. Since only ledge 270 is engaged by outer ridge portion 232 to retain lifter body 214 within anti-rotation guide 250 in accordance with the invention, substantially no frictional force exists between lifter body 214 and anti-rotation guide 250. Thus, the force exerted against lifter body 214 by plunger spring 276 is not substantially counteracted by friction between lifter body 214 and anti-rotation guide 250. Therefore, substantially all of the force of plunger spring 276 is used to bring pin housing 220, lifter body 214 and roller 212 into engagement with the cam lobe of the engine camshaft. The adverse effects, i.e., lifter noise or clatter, of the constraints imposed upon the size and force of plunger spring 276 are therefore reduced.

Spring tower 226 of DRHVL 200 includes first portion 226*a* and second portion 226*b*. First portion 226*a* is of a smaller diameter relative to second portion 226*b*, and thus spring tower 226 has a stepped outside diameter. The increased diameter of second portion 226*b*, relative to the smaller diameter of spring tower 26 of DRHVL 10 and relative to the smaller diameter of first portion 226*a*, increases the angle through which pushrod 259 can pivot relative to central axis A1 without contacting second portion 226*b* of spring tower 226 and helps to center the end of the pushrod with the center of socket 219 of pushrod seat assembly 222. Further, the increased diameter of second portion 226*b* enables the use of larger-diameter lost motion spring 224 having an increased spring force, thereby increasing the engine oil pressure limit under which DRHVL 200 is operable.

Second portion 226*b* of spring tower 226 also includes opening 225 through which pushrod 259 enters DRHVL 200 for engagement with pushrod seat assembly 222. A plurality of flutes 282 (FIG. 5) disposed axially about the inner surface of anti-rotation guide 250 serve to centrally guide pushrod 259 toward pushrod seat assembly 222 during engine assembly. Edge surfaces 284 of flutes 282 serve to guide ball end 259*a* of pushrod 259 away from tower collar 246 when the pushrod is inserted into DRHVL 200 through guide 250.

Figure 6:
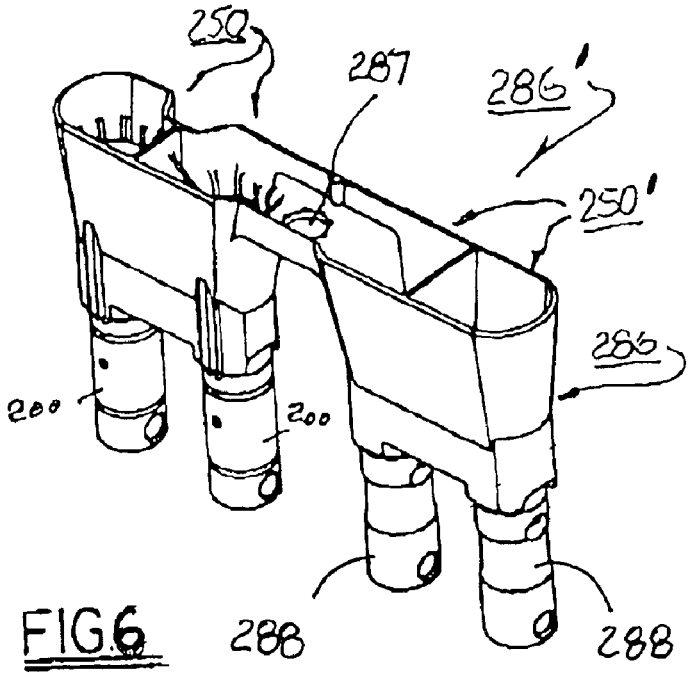
FIG. 6 is a perspective view of a multiple anti-rotation guide element assembly in accordance with the invention, shown with two deactivating valve lifters and two standard valve lifters installed in the anti-rotation guide element.
Figure 7:
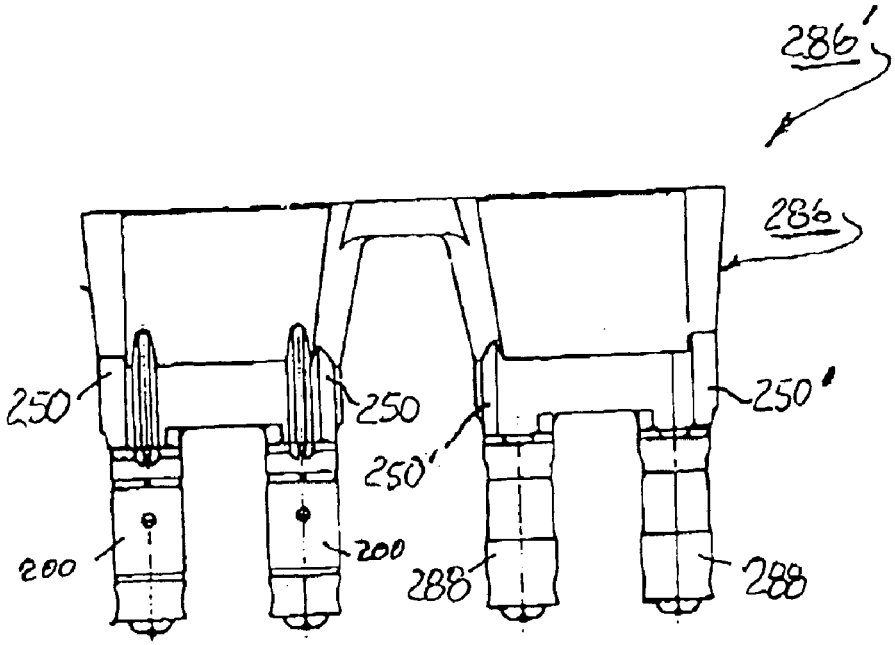
FIG. 7 is an elevational view of the guide element assembly shown in FIG. 6.
Figure 8:
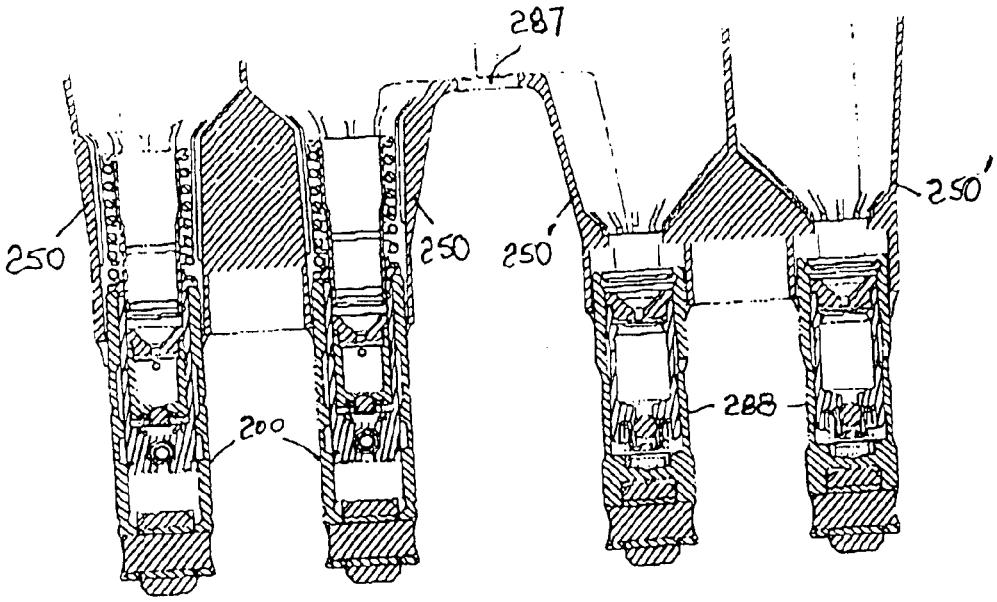
FIG. 8 is a vertical cross-sectional view of the guide element assembly shown in FIG. 6, taken along line 8—8 in FIG. 10.

Referring to FIGS. 6 through 8, guide 250 of the present invention may be conveniently provided in a ganged element 286 wherein a plurality of guides are formed for use with an equal number of lifters. In element 286, two of the guides 250 are intended for use with DRHVL 200; and the other two guides 250' are intended for use with standard, non-deactivating lifters 288. Thus, the four guides may be conveniently mounted to engine 31 as a unit such as, for example, via a single bolt (not shown) through bolt hole 287, as known in the art. The four-lifter guide element 286 permits four appropriate lifters to be pre-assembled as a kit 286' and then installed simultaneously into engine 31.

Referring again specifically to FIGS. 5, 11 and 12, guide 250 is provided with two keepers 256 for engaging two flats

214*a*,214*b* as described above, to provide sufficient torque to resist rotation of the lifter body in its mating guide during engine operation. Each deactivation lifter 200 has an oil port 238 that must mate with a corresponding control oil passage 31 a in engine 31, requiring that lifter 200 must be correctly oriented when inserted into its bore 19 in engine 31; a single flat 214*a* can provide such orientation, but would provide less torque to resist rotation of the lifter body in its mating guide, as compared to the two-flat design. A second and opposing flat can provide added resistance to lifter rotation, but the addition of a second and opposite flat 214*b* creates ambiguity. In guide 250, such ambiguity is resolved by providing an indexing rib 290 (FIG. 11) in one of flats 214*b*, and a mating longitudinal groove 291 in one of keepers 256 for engagement with rib 290. Conversely, rib 290 may be provided in one of flats 214*a*,214*b* and grooves 291 may be provided in one of keepers 256. In the present invention, engagement walls 292 and 293, of rib 290 and groove 291, respectively, are formed perpendicular to flats 214*a,b* and parallel to each other, to provide greater resistance to rotation of the lifter body in its mating guide.

Figure 12:
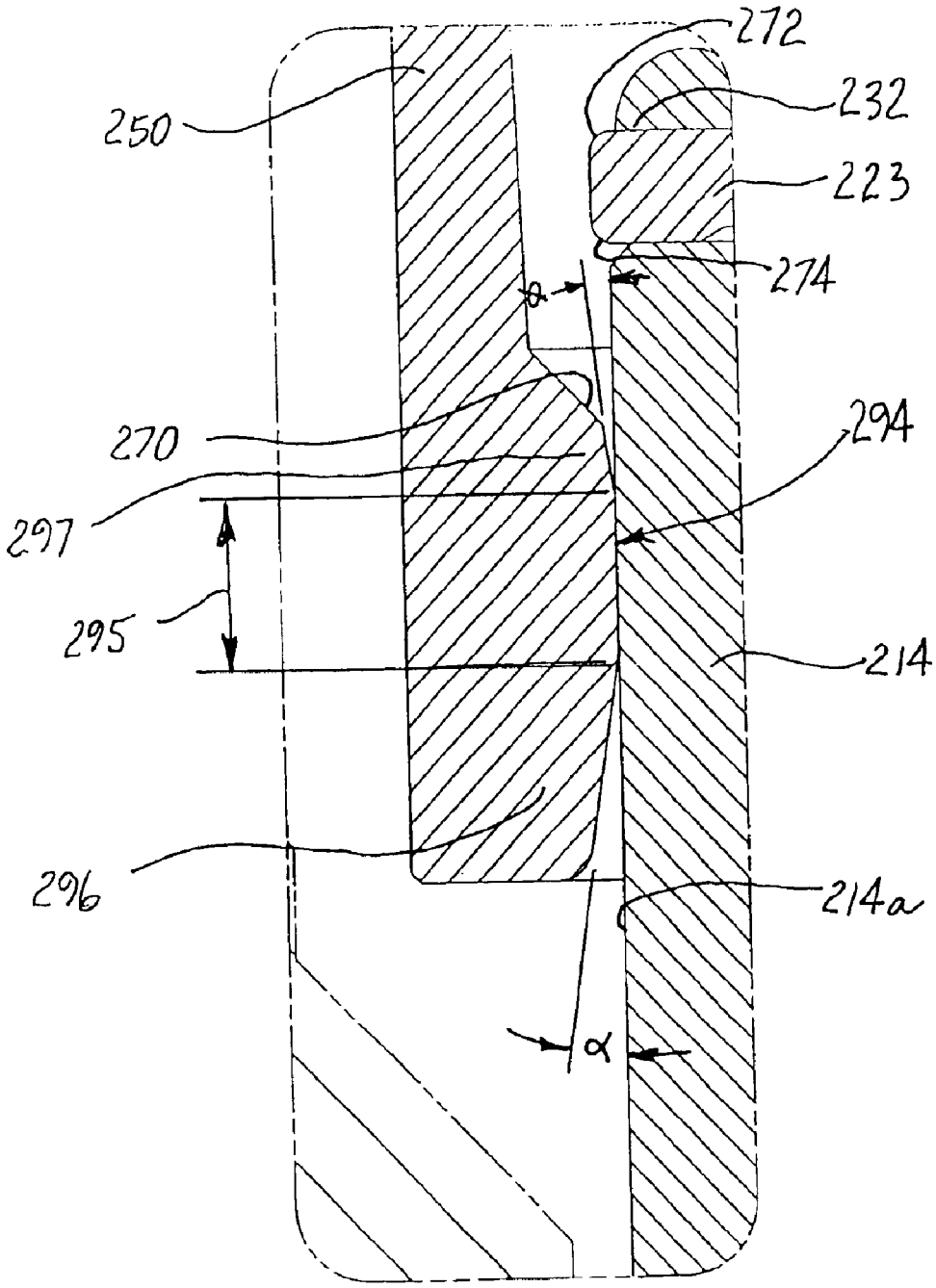
FIG. 12 is a magnified view of box 12 in FIG. 5.

Referring to FIG. 12, preferably, the longitudinal edge 294 of keepers 256 is formed in an hourglass shape so that only mid segment 295 of edge 294 is parallel to flats 214*a*,214*b* of body 214. This shape permits outer ridge portion 232 to engage ledge 270 of ant-rotation guide 250 while in kit 286' form prior to engine installation. Yet, after assembly, relief angle $\alpha$ of first segment 296 and relief angle $\theta$ of second segment 297 permit some angular deviation of body 214 from centerline A2 of anti-rotation guide 250 after kit 286' is installed in engine 31. Preferably, relief angles $\alpha$ and $\theta$ are less than 10°. Preferable, the length of mid segment 295 that is parallel with flats 214*a*,214*b* is approximately 2.0 mm.

This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. An anti-rotation guide mechanism for retaining a valve lifter, comprising:

an anti rotation guide having a bore for receiving a portion of said lifter, said guide having first and second keeper portions;

said lifter including an outer ridge portion extending beyond a body of said lifter;

wherein engagement of at least one of said first and second keeper portions with said outer ridge portion retains said valve lifter in said bore, and wherein said outer ridge portion includes a leading edge and a trailing edge and at least one of said leading edge and said trailing edge includes a radius.

2. An anti-rotation guide mechanism for use with a valve lifter, comprising:

an anti-rotation guide having a wall surrounding a bore for receiving a portion of said lifter, said wall having first and second keeper portions defining a first width;

said lifter including an outer ridge portion, said outer ridge portion defining a second width;

wherein said second width is greater than said first width for retaining said lifter in said bore, and wherein said bore defines a first diameter, said portion of said lifter defines a second diameter, and said first diameter and said second diameter conjunctively define an annular clearance when said portion of said lifter is received in said bore.

3. An anti-rotation guide mechanism for use with a valve lifter, comprising:

an anti-rotation guide having a wall surrounding a bore for receiving a portion of said lifter, said wall having first and second keeper portions defining a first width;

said lifter including an outer ridge portion, said outer ridge portion defining a second width;

wherein said second width is greater than said first width for retaining said lifter in said bore, and wherein said outer ridge portion includes a leading edge and a trailing edge, at least one of said leading edge and said trailing edge includes a radius.

4. An anti-rotation guide mechanism for use with a valve lifter, comprising:

an anti-rotation guide having a wall surrounding a bore for receiving a portion of said lifter, said wall having first and second keeper portions defining a first width;

said lifter including an outer ridge portion, said outer ridge portion defining a second width;

wherein said second width is greater than said first width for retaining said lifter in said bore, and wherein said first and second keeper portions include a first segment, mid segment and second segment, said mid segment defines said first width, and at least one of said first and second segments is configured to permit angular deviation of an axis of said lifter relative to an axis of said guide when said portion of said lifter is received in said bore.

5. An anti-rotation guide mechanism for use with a valve lifter, comprising:

an anti-rotation guide having a wall surrounding a bore for receiving a portion of said lifter, said wall having first and second keener portions defining a first width;

said lifter including an outer ridge portion, said outer ridge portion defining a second width;

wherein said second width is greater than said first width for retaining said lifter in said bore, wherein one of said guide and said lifter includes a longitudinal rib for engaging a mating longitudinal groove in the other of said guide and said lifter for orienting said lifter when received in said bore, and wherein said portion of said valve lifter further includes at least one flat, said longitudinal groove includes a mating wall, said longitudinal rib includes a mating wall, and said mating walls are substantially perpendicular to said at least one flat.

* * * * *